US006026900A

United States Patent [19]

Keller

[11] Patent Number: 6,026,900

[45] Date of Patent: Feb. 22, 2000

[54] MULTIPLE LINER METHOD FOR BOREHOLE ACCESS

[76] Inventor: Carl E. Keller, P.O. Box 9827, Santa Fe, N.Mex. 87504

[21] Appl. No.: 09/098,025

[22] Filed: Jun. 15, 1998

[51] Int. Cl.[7] ..... E21B 17/00; E21B 33/10; E21B 43/25; E21B 47/01

[52] U.S. Cl. ..... 166/250.01; 166/66; 166/72; 166/97.1; 166/242.2; 166/242.3; 166/244.1; 166/384; 166/385; 405/184

[58] Field of Search ..... 166/64, 66, 72, 166/77.1, 85.1, 97.1, 100, 242.2, 242.3, 244.1, 250.01, 264, 380, 384, 385, 387; 405/154, 156, 184

[56] References Cited

U.S. PATENT DOCUMENTS

| | | | |
|---|---|---|---|
| 2,583,316 | 1/1952 | Bannister | 166/387 |
| 2,927,775 | 3/1960 | Hildebrandt . | |
| 4,976,322 | 12/1990 | Abdrakhmanov et al. | 166/380 X |
| 5,176,207 | 1/1993 | Keller | 166/64 |
| 5,181,565 | 1/1993 | Czernichow | 166/100 X |
| 5,524,709 | 6/1996 | Withers | 166/250.1 |
| 5,794,702 | 8/1998 | Nobileau | 166/380 |
| 5,803,666 | 9/1998 | Keller | 405/154 X |
| 5,853,049 | 12/1998 | Keller | 166/380 |

*Primary Examiner*—George Suchfield

[57] ABSTRACT

A method is provided for supporting and sealing structure defining a generally cylindrical hole while introducing and removing devices from the hole. A first flexible liner is installed in the hole and pressurized to a pressure effective to support and seal the structure. A second flexible liner is everted between the first flexible liner and the structure, where the second flexible liner carries the devices to introduce and remove the devices from the hole while the first liner remain pressurized to continuously support and seal the structure.

6 Claims, 2 Drawing Sheets

MULTIPLE LINER METHOD FOR BOREHOLE ACCESS

FIELD OF THE INVENTION

This invention relates to everting borehole liners, and, more particularly, to the use of multiple liners for borehole access while the borehole remains sealed.

BACKGROUND OF THE INVENTION

In drilling boreholes for emplacement of measurement or sampling devices, the common practice is to install the desired device in the borehole and then to seal the hole with a grouted liner to fill the entire hole with a sealing material. This limits the use of the hole to that particular sampling or measurement device. Yet another approach is to use a solid casing to support the borehole and then place instrumentation within the casing. The use of the solid casing complicates access of the measurement and sampling devices to the surrounding geologic structure. If instrumentation is included on the casing, the borehole is unsupported and unsealed when the casing is removed for obtaining the collected samples or to change instrumentation.

U.S. Pat. No. 5,176,207, issued Jan. 5, 1993, to Keller, teaches the use of a flexible tubular member to both seal and support a borehole and to carry instrumentation into a borehole as the flexible member is everted into the borehole. Instrumentation and sampling devices can then be placed directly in contact with the surrounding structure. This device provides many improvements in borehole support while obtaining in situ measurements within a borehole. But the everted member must be inverted from within the borehole in order to obtain sample materials collected by the sampling devices or to change measurement instruments placed within the borehole by the everting membrane. When the tubular member is inverted, the borehole is again unsupported and the borehole might then collapse or fill with fluids from the surrounding structure, which tends to intermix the geologic structure and contained fluids so that subsequent sampling and measurements from that borehole will riot provide reliable information.

Accordingly, an object of the present invention is to obtain reliable measurements and sampling from within a borehole while the borehole remains supported and sealed at all times Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the method of this invention is a method for supporting and sealing structure defining a generally cylindrical hole while introducing and removing devices from the hole. A first flexible liner is installed in the hole and pressurized to a pressure effective to support and seal the structure. A second flexible liner is everted between the first flexible liner and the structure, where the second flexible liner carries the devices while the first liner remain pressurized to continuously support and seal the structure.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings:

FIG. 4 is a cross-sectional view of a pair of liners inserted into a borehole, or the like.

DETAILED DESCRIPTION

In accordance with the present invention, at least two flexible liners are used to introduce instrumentation and sampling devices within a structure, such as a borehole, pipe, or the like. A first flexible liner is inserted to seal and support the structure. A second flexible liner is then inserted between the first liner and the structure to insert the instrumentation and sampling devices.

Suitable liners for supporting and sealing a borehole are well known. For example, U.S. Pat. No. 2,927,775 to Hildebrandt teaches a flexible core barrel for lining a borehole through unconsolidated materials, incorporated herein by reference. Everting flexible liners for supporting and sealing a borehole are described in U.S. Pat. Nos. 5,803,666 and 5,853,049, both to Keller, also incorporated herein by reference. The first liner prevents borehole collapse and also prevents the inflow and subsequent outflow of contamination from the borehole to reduce the spread of contamination. The sealing of the hole also reduces the influence of the borehole on the natural state of the geologic medium that is to be tested.

In accordance with the present invention, a second liner may now be inserted between the first liner and the borehole so that the borehole is continuously supported and sealed as the second liner is introduced. U.S. Pat. No. 5,176,207, issued Jan. 5, 1993, to Keller and incorporated herein by reference, describes a suitable everting liner system for introducing instrumentation and sampling devices within a borehole that may be used with an installed first liner as described herein. As the second liner is everted within the borehole, the first liner is locally displaced, but the borehole remains supported and sealed. When the second liner is inverted for removal, the first liner again expands to fill the borehole so that the borehole remains supported and sealed. The method of my invention allows the full use of a single hole for many different kinds of measurements, at different locations in the borehole and at many different times. Further, the borehole is available for other uses, such as injection or extraction of pore fluids after the testing is completed.

Figure 1A:
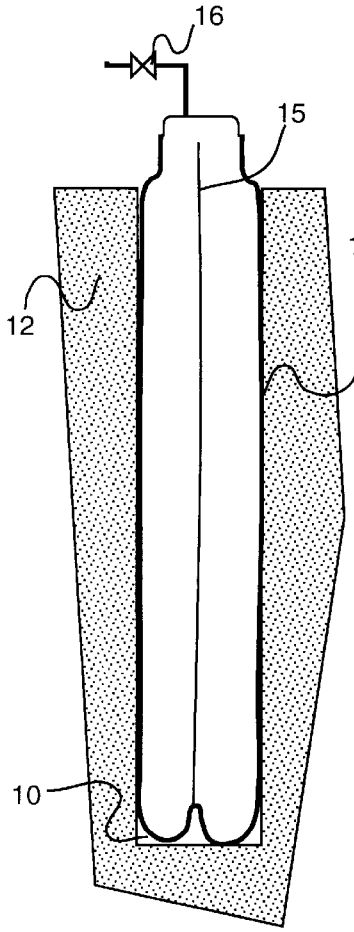
FIGS. 1A and 1B are cross-sectional views of a supporting liner installed within a borehole.
Figure 1B:
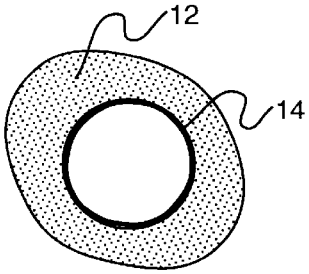

Referring first to FIGS. 1A and 1B, there are shown cross-sectional views of a first liner 14 installed in borehole 10 that has been augured or otherwise formed in a surrounding geologic structure 12. First liner 14 may be placed within the borehole using many different techniques. If borehole 10 has sufficient diameter, liner 14 may be simply lowered into borehole 10 and liner 14 is then pressurized with a suitable fluid, such as air or water, introduced through a suitable valve device in liner cap 16. For small diameter boreholes, liner 14 may need to be everted into borehole 10, as described in the '207 patent. An everting liner may also be required if the borehole is horizontal. Line 15 is provided for retracting liner 14 from within borehole 10.

Figure 2A:
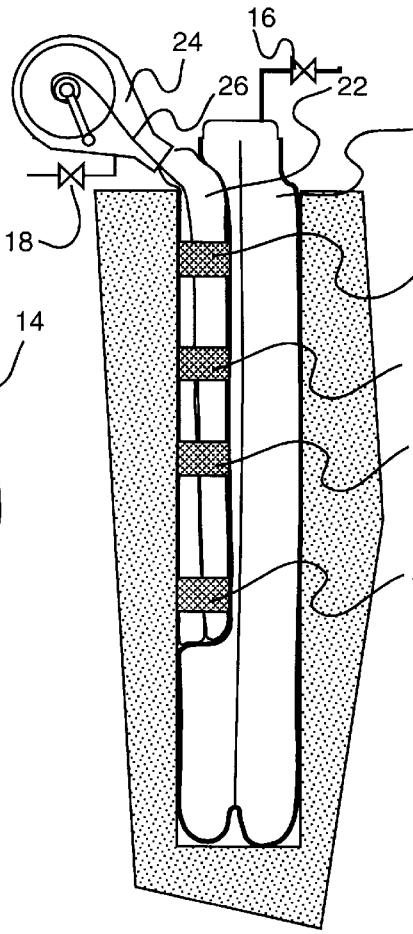
FIGS. 2A and 2B are cross-sectional views of a supporting liner installed within a borehole with an instrumentation liner everting therein.
Figure 3A:
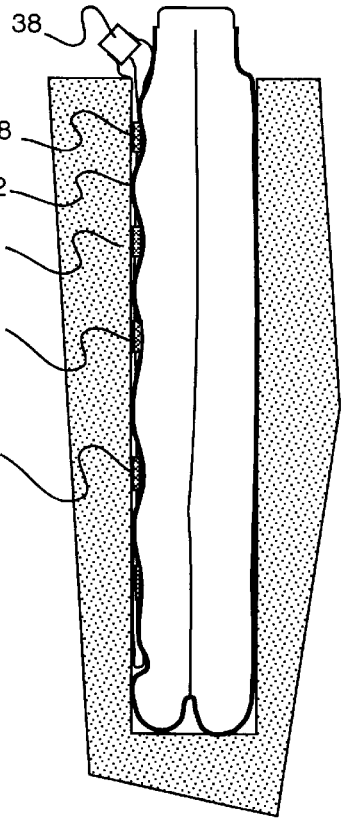
FIGS. 3A and 3B are cross-sectional views of a supporting liner installed within a borehole with instrumentation and sampling devices urged against surrounding geologic structure.
Figure 2B:
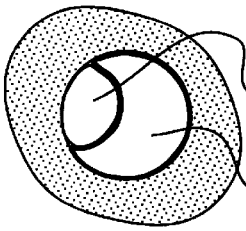
Figure 3B:
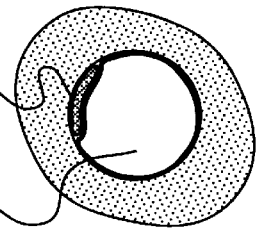

FIGS. 2A and 2B are cross-sectional views of second liner 22 being installed between first liner 14 and the walls defining borehole 10. Second liner 14 is everted from reel canister 24 along with retracting line 26. As described in the '207 patent, canister 24 is pressurized to cause second liner 22 to evert. A part of first liner 14 extending from the top of borehole 10 is first pushed aside to initiate the everting process and second liner 22 continues to push aside first liner 14 as second liner 22 everts between first liner 14 and the wall of borehole 10. The pressure required for everting second liner 22 is greater than the internal pressure within first liner 14 that is being used to support and seal borehole 10. Everting second liner 22 preferably has a diameter less than the diameter of first liner 14, but the flexible nature of the liners permits a wide variety of liner diameters to be used, provided that at least the diameter of first liner 14 is as great as the diameter of borehole 10.

The installation of second liner 22 compresses the working fluid within first liner 14, but flexible first liner 14 continues to support and seal borehole 14. Flexible second liner 22 completely fills the space between first liner 14 and borehole 10 so that the entirety of borehole 10 is supported and sealed during the entire procedure. The pressure within first liner 14 can be monitored and controlled through valve device 16 as second liner 22 is being everted. If first liner 14 is filled with a fluid, fluid is simply released through valve device 16 as the volume of first liner 14 is compressed.

A special feature of this installation of second flexible liner 22 in a borehole 10 occupied by first flexible liner 14 is that the two liners conform to one another in a manner to allow the minimum passageway for air or liquid flow between the two liner and the wall of borehole 10. This conformity has been found to be best achieved if the two liners are at about the minimum pressure needed to support borehole 10 to minimize the tension in the impermeable liner materials and at a pressure in second liner 22 near to the pressure in first liner 14, i.e., a pressure that is the minimum needed to evert second liner 22.

Once second liner 22 is everted to the desired depth, second liner 22 is preferably deflated, as shown in cross-sectional views 3A and 3B, and the top of second liner 22 is topped with attachment 38 for attaching canister 24 (FIG. 2B). First liner 14 then urges second liner 22 against the wall of borehole 10 to place exemplary instruments and sampling devices 28, 32, 34, and 36 into more intimate contact with the geologic structure forming borehole 10. In one embodiment, one or more of devices 28, 32, 34, and 36 may be a viewing device for viewing interior portion of borehole 10 as liner 22 everts within borehole 10. Deflating second liner 22 is not typically required in order to obtain the desired measurements and samples, but there is no need to maintain pressure within second liner 22 while measurements and samples are being taken.

Second liner 22 is readily removed by an inversion process for second liner 22. If deflated, second liner 22 is inflated to a pressure greater than first liner 14. Reel canister 24 is attached to second liner 22 at attachment 38 and inverting line 26. Second liner 22 then is inverted while steadily releasing pressure from within second liner 22 to maintain a relatively constant pressure. As second liner 22 is shortened by inversion, first liner 14 expands to fill the void that would be left otherwise by the removal of second liner 22. Again, the ability of first liner 14 to conform to second liner 22 in its length change is a particular feature of this invention. Fluids from geologic structure 12 are not released and atmospheric gases do not flow into contact with geologic structure 12 during this process. At all times, the walls of borehole 10 are supported by first liner 14 to prevent collapse of borehole 10.

It should also be noted that the presence of first liner 14 permits second liner 22 to be retrieved reliably by the inversion process. Without first liner 14, second liner 22, which has a diameter smaller than the diameter of borehole 10 may buckle axially instead of inverting.

The above method is useful for the installation of a variety of sampling devices or instruments on the second liner 22 for extraction of pore fluids from geologic structure 12. Suitable sampling devices may include absorbers for wicking pore liquid sample, tubing for drawing gas or liquid samples, and the like. Sensors may include electrodes for measurement of properties of fluids and materials surrounding borehole 10.

Second liner 22 can be used also to tow logging tools, cameras and other instruments into boreholes sealed by first liner 14. The selected device is pulled along the interior cf a second liner 22 as second liner 22 is everted into borehole 10.

Second liner 22 is formed of a transparent material when visual access to the borehole wall is required, e.g., when a camera is being towed. This is especially useful in horizontal boreholes where first liner 14 continuously supports the borehole walls.

In yet another application of the dual liner process, the pair of liners 14, 22 can be used to asymmetrically load the hole wall. Once second liner 22 is in place (FIG. 4), first liner 14 and second liner 22 are inflated with the same increasing pressure. As liners 14, 22 tend to form their individual cylindrical shapes under ever higher pressure, the borehole is deformed, as shown in FIG. 5.

This local deformation may cause the geologic structure 12 to fracture for purposes of obtaining greater access to the adjacent pore space in geologic structure 12 to enhance extraction or injection of fluids or to allow decontamination of the surrounding structure. It will be noted that this fracture process does not require (or allow) the introduction of fracture fluids into the surrounding geologic structure. The flow of fluid into the surrounding pore space can degrade the fracturing procedure.

Figure 5:
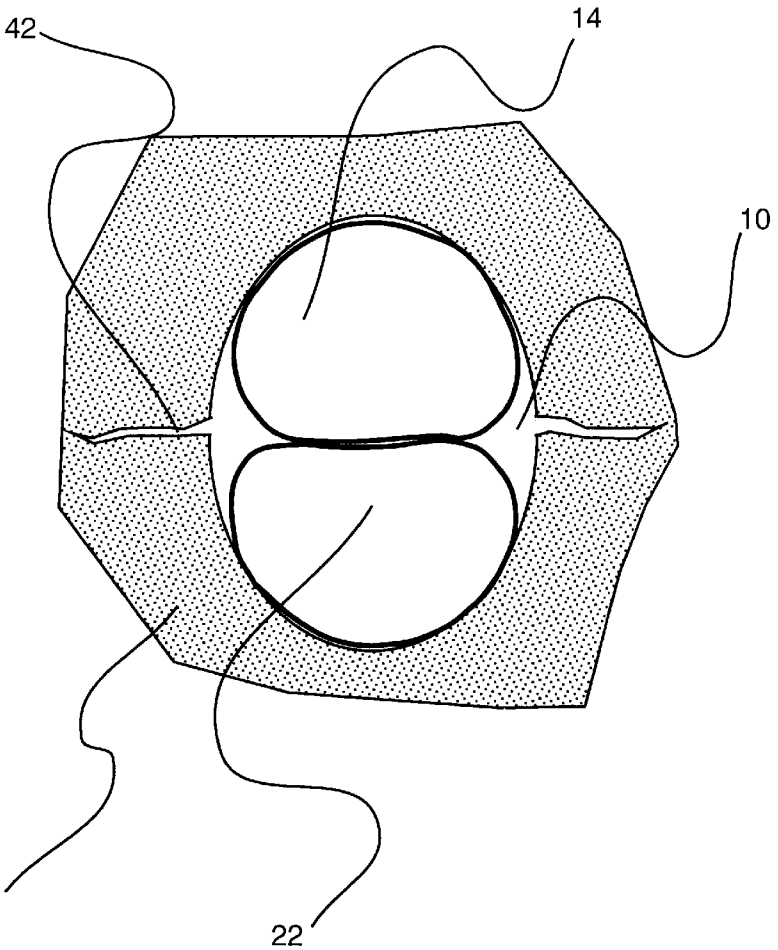
FIG. 5 is a cross-sectional view of a pair of liners that have been pressurized to deform or initiate fracture in a surrounding structure, such a borehole.
Figure 4:
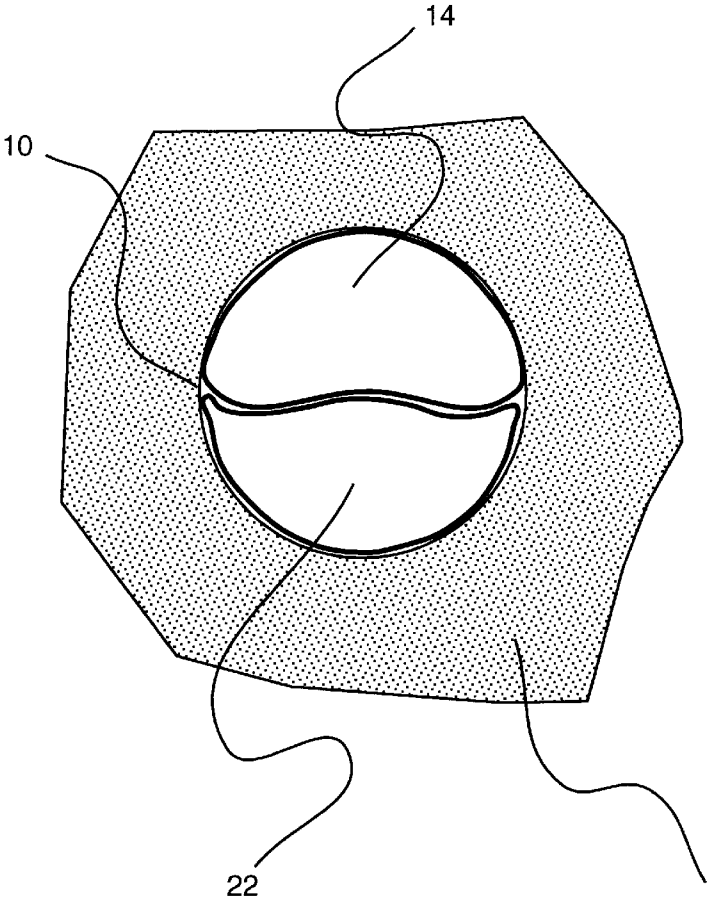

FIGS. 4 and 5 depict a particular adaptation of the present invention to fracture a geologic structure 12. In this case, shown in FIG. 4, first liner 14 and second liner 22 are about the same diameter to equally fill borehole 10 when fully inserted and pressurized. In this application, each liner may be slightly smaller than the diameter of borehole 10, but the selection of diameters is not critical.

Once liners 14 and 22 are in place, the liners are pressurized to exert an asymmetric force on geologic structure 12 that defines borehole 10. The pressure is increased until fractures 42 are initiated in geologic structure 12.

The above processes may use more than one liner in addition to the first liner that supports and seals the borehole. Additional liners permit additional information to be obtained and samples collected, or permit additional fracturing or propagation of fractures initiated by a first pair of liners.

While the above process has been described with reference to a borehole, the process is well adapted to use in any open structure, such as piping, sewer lines, or other piping where the interior of the piping must be sealed and/or supported while measurement devices are traversing the structure.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method for supporting and sealing structure defining a generally cylindrical hole while introducing and removing devices from said hole, comprising the steps of:

installing a first flexible liner in said hole;

pressurizing said first flexible liner to a pressure effective to support and seal said structure; and everting a second flexible liner between said first flexible liner and said structure, where said second flexible liner carries said devices while said first liner remains pressurized to continuously support and seal said structure.

2. A method according to claim 1, further including the steps of:

pressurizing said second flexible liner to a pressure greater than said pressure of said first flexible liner to evert said second flexible liner; and controlling pressure in said first flexible liner as said first flexible liner is compressed as said second flexible liner is everted.

3. A method according to claim 1, further including the steps of:

installing instrumentation and sampling devices on said second flexible liner; and deflating said second flexible liner after everting into said hole wherein pressure in said first flexible liner urges said instrumentation and sampling devices toward said structure defining said hole.

4. A method according to claim 1, further including the steps of:

forming said second flexible liner of a transparent material; and installing a viewing device within said second liner for viewing interior portions of said structure as said second liner everts within said hole.

5. A method for deforming structure defining a generally cylindrical hole, comprising the steps of:

installing a first flexible liner in said hole;

pressurizing said first flexible liner to a pressure effective to support and seal said structure;

everting a second flexible liner between said first flexible liner and said structure; and pressurizing said first and second flexible liners to exert asymmetrical pressure within said structure to deform said structure.

6. A method according to claim 5, wherein said cylindrical structure is a borehole and said first and second liners are pressurized to fracture geologic structure defining said borehole.

* * * * *